United States Patent [19]

Chevalier

[11] Patent Number: 4,500,155

[45] Date of Patent: Feb. 19, 1985

[54] PLUG-IN ELECTRIC CONNECTOR FOR USE IN A LIQUID MEDIUM

[75] Inventor: André Chevalier, Pantin, France

[73] Assignee: Institut Francais du Petrole, Rueil-Malmaison, France

[21] Appl. No.: 358,990

[22] Filed: Mar. 17, 1982

[30] Foreign Application Priority Data

Mar. 17, 1981 [FR] France ..... 81 05306

[51] Int. Cl.[3] ..... H01R 13/523

[52] U.S. Cl. ..... 339/94 M; 339/116 C; 339/117 R

[58] Field of Search ..... 339/94 R, 96, 116 C, 339/115 C, 117 R, 94 M, 117 P; 174/8, 12 R; 92/42, 92

[56] References Cited

U.S. PATENT DOCUMENTS

| | | | |
|---|---|---|---|
| 1,879,746 | 9/1932 | Holden | 174/12 R |
| 2,404,801 | 7/1946 | Hollerith | 92/92 |
| 3,645,173 | 2/1972 | Yarlott | 92/92 |
| 4,373,767 | 2/1983 | Cairns | 337/117 R X |
| 4,390,229 | 6/1983 | Chevalier | 339/117 R X |

FOREIGN PATENT DOCUMENTS

| | | | |
|---|---|---|---|
| 2070348A | 9/1981 | United Kingdom | 339/96 |

*Primary Examiner*—Eugene F. Desmond
*Assistant Examiner*—Steven C. Bishop
*Attorney, Agent, or Firm*—Millen & White

[57] ABSTRACT

A plug-in connector for use under water comprises a socket having a bore adapted to receive a complementary plug and a chamber formed in the socket structure between a rigid tube co-axial with the socket and a surrounding elastic sleeve. The tube is perforated with regularly spaced holes, and the chamber is filled with an insulating grease with the interior of the tube being in permanent communication with the bore of the socket.

15 Claims, 3 Drawing Figures

1
2
3
4
5
6
7
8
8a
8b
9
10
11
12
13
14
15
16

PLUG-IN ELECTRIC CONNECTOR FOR USE IN A LIQUID MEDIUM

BACKGROUND OF THE INVENTION

This invention concerns a plug-in connector suitable for use in a liquid medium such as water.

Plug-in connectors suitable for use under water are known in the prior art and described, for example, in U.S. Pat. Nos. 3,508,188, 3,585,567, 3,772,636, 3,845,450, 3,877,775 and 4,039,242.

These connectors make use of movable parts which cover electrical contacts when the two elements forming the connector are separated, and which are automatically pushed back, into a housing provided therefor when the two elements of the connector are assembled. An insulating liquid such as an oil in equipressure relationship with the external medium, completes the protection of the electric contacts and prevents penetration of water into the connector.

Such connectors may give satisfactory results but are expensive and fragile because-therefor of their movable parts. In addition, they require good sealing to limit any leakage of the insulating liquid.

In order to obviate these drawbacks, other connectors have been built which comprise a socket and a complementary plug, the latter being adapted to push back an insulating material of high viscosity into a chamber in equipressure relationship with the external medium. When the plug is withdrawn from the socket, the space left free is automatically filled with the insulating material. The chamber of insulating material generally comprises a deformable wall consisting, for example, of a flexible membrane.

The problem to be solved is then to make use of a minimum amount of insulating product and, accordingly, to ensure a good transfer of said insulating product between the chamber and the space left free by the plug withdrawal.

SUMMARY OF THE INVENTION

The object of the present invention is to provide a particular embodiment of a chamber for insulating product, with this chamber permitting an easy transfer of this product.

The connector according to the present invention comprises a socket provided with a bore adapted to receive a complementary plug and a chamber of insulating product communicating with the bore of the socket, this chamber being formed by a rigid tube, the wall of which is traversed by a plurality of channels and by an elastic sleeve surrounding the rigid tube, the interior of the rigid tube communicating with the bore of the socket.

BRIEF DESCRIPTION OF THE DRAWINGS

The invention will be better understood and all its advantages will be made apparent from the following description illustrated by the accompanying drawings wherein.

DETAILED DESCRIPTION OF THE INVENTION

Figures 1A, 1B, 1C, 1D:
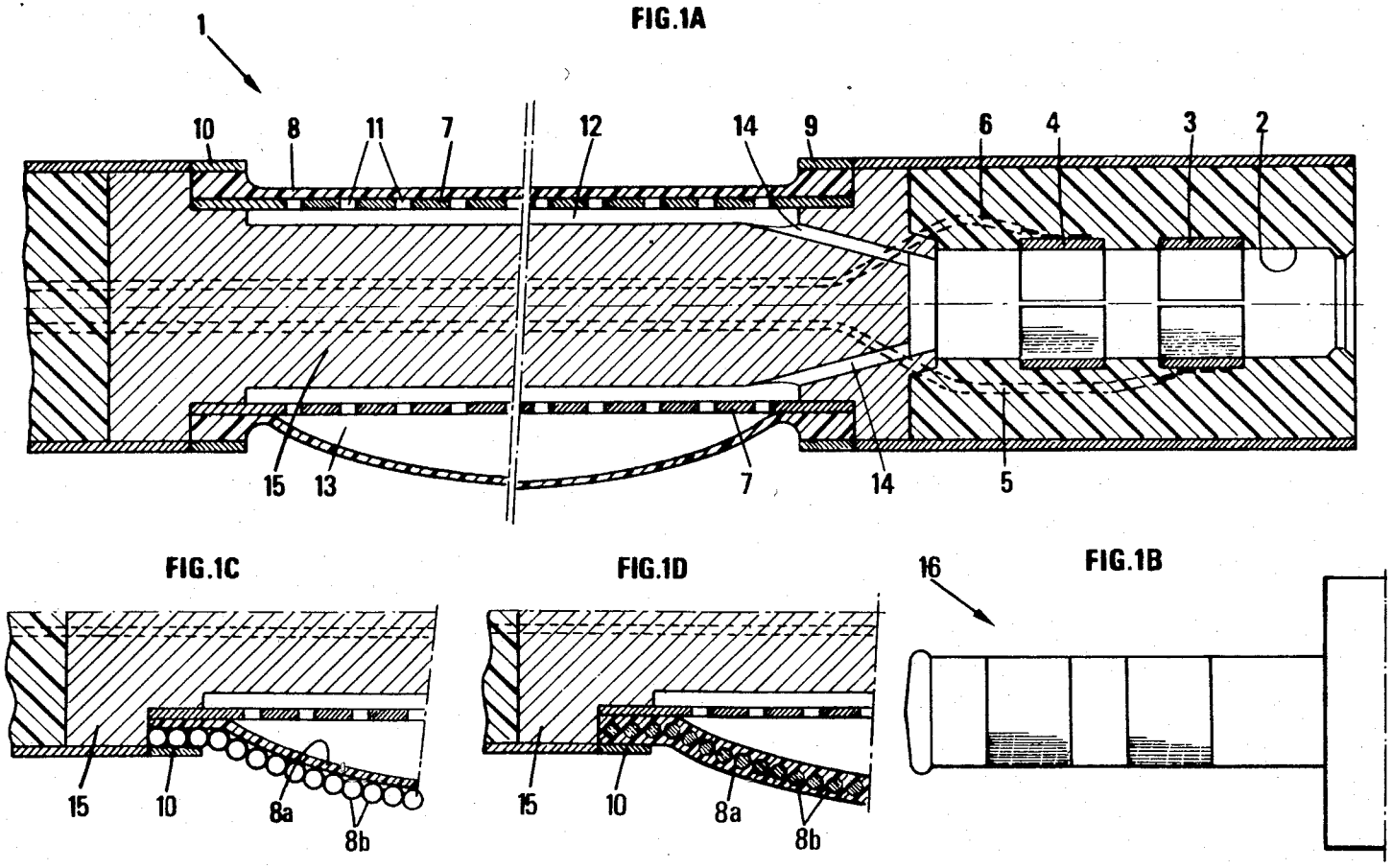
FIG. 1A diagrammatically shows a socket according to the invention.
FIG. 1B shows a type of plug-in connector which can be inserted into the socket of the invention.
FIG. 1C is a detailed view of another embodiment of socket according to the invention.
FIG. 1D shows a reinforcing device embedded in the elastic sleeve.

The socket forming part of the connector is shown in cross-section in FIG. 1A. This socket, designated as a whole by reference 1, comprises a bore 2 wherein are maintained electrical contacts 3 and 4, connected respectively to conductors 5–6.

Two electric contacts have been shown by way of example, but this number is by no way limitative.

The socket is provided with a chamber of insulating product, formed between a rigid tube 7, preferably arranged coaxially to the socket and an elastic sleeve 8 surrounding the tube 7. At each of its ends the sleeve 8 is secured to the tube 7, for example by means of fastening rings 9–10.

The elastic sleeve may be constituted, for example, by an extensible flexible membrane 8. In this case, in order to increase the return forces and to compensate for a possible loss of the mechanical properties of the membrane, it is possible, but not compulsory to make use of an additional reinforcing device.

According to an embodiment of the invention, this device consists of a spring with contiguous coil turns of small diameter **8*b* (FIG. 1C) surrounding the elastic membrane 8*a* (FIG. 1C**).

It is also possible to make use of a piling of ring springs encircling the membrane.

The two reinforcing devices described above by way of example may be embedded in the mass of elastic material of which the membrane is made, (FIG. 1D).

The wall tube 7 is pierced with holes or channels 11 preferably regularly spaced, interconnecting the bore 12 of tube 7 with a space 13 defined between the external wall of tube 7 and the internal wall of the elastic sleeve 8.

The bore 12 permanently communicates with the bore 2 of the socket 1. In this illustrated embodiment, this communication is established through ducts 14 bored into the body 15 of the socket 1.

Under the conditions of use of the socket, the bores 2 and 12 are filled up with an insulating product of substantial viscosity such as an insulating grease. The elastic sleeve 8 is then in the position shown at the upper part of FIG. 1A.

When the plug 16 (FIG. 1B) is introduced into the socket 1, the insulating grease contained in bore 2 is expelled into the grease chamber 13 through the ducts 14 and the bores 11 while causing an elastic deformation of the sleeve 8 as shown in the lower part of FIG. 1A.

When the plug 16 is withdrawn from the socket 1, the insulating grease is forced into the bore 2 through the port 11 and the ducts 14.

Modifications may be brought without departing from the scope of the present invention. For example, ports 11 may be circular as shown in FIG. 1A or may consist of oblong slots.

What is claimed is:

1. A plug-in connector for use underwater, comprising a socket provided with a bore adapted to receive a complementary plug, and a chamber containing an insulating product of substantial viscosity in communication with the bore of the socket for filling said bore with insulating product when said plug is withdrawn from the socket, said chamber comprising a rigid tube having a wall traversed by a plurality of channels and an elastic sleeve surrounding the tube and defining therewith said chamber of insulating product, the interior of said rigid tube being in permanent communication with said bore of said socket, and said sleeve constructed of sufficient elasticity for expelling insulating product from the chamber as a result of its elasticity for contacting substantially the entire surface of the outer wall of said rigid tube when said plug is withdrawn from said socket, and for causing said insulating product to fill said socket.

2. A connector according to claim 1, wherein said channels have an oblong cross-section.

3. A connector according to claim 1, wherein said channels have a circular cross-section.

4. A connector according to claim 1, wherein said elastic sleeve comprises an extensible flexible membrane.

5. A connector according to claim 4, further comprising a reinforcing device operatively associated with the extensible flexible membrane, and said reinforcing device being adapted to press said membrane in contact with said wall when said plug is withdrawn from said socket.

6. A connector according to claim 5, wherein said reinforcing device consists essentially of at least one spring, said spring being adapted to expell said insulating product into said bore when said plug is withdrawn from said socket.

7. A connector according to claim 5, wherein said reinforcing device is embeded into the mass of substance of which the extensible flexible membrane is made.

8. A connector according to claim 6, wherein said spring is embedded into the mass of the substance forming the extensible flexible membrane.

9. A connector according to claim 1, wherein a single space is defined between the external surface of said rigid tube and the inner surface of said elastic sleeve when said plug is inserted into said socket, with said space being the interior of said chamber containing said insulating product.

10. A connector according to claim 4 wherein said flexible membrane is arranged for being forced outwardly by insulating product being forced into said chamber defined thereby when said plug is inserted into said socket.

11. A plug-in connector for use underwater, comprising a socket provided with a bore adapted to receive a complementary plug and a separate chamber containing an insulating product of substantial viscosity in communication with the bore of the socket through channel means, said channel means arranged in a zone separate and distinct from the bore wherein said plug is received, for filling said bore with insulating product when said plug is withdrawn from the socket, said chamber comprising a rigid tube having a wall traversed by a plurality of channels and an elastic sleeve surrounding the tube and defining therewith said chamber of insulating product, the interior of said rigid tube being in permanent communication with said bore of said socket, and said sleeve constructed of sufficient elasticity for expelling insulating product from the chamber as a result of its elasticity for contacting substantially the entire surface of the outer wall of said rigid tube when said plug is withdrawn from said socket, and for causing said insulating product to fill said socket.

12. A plug-in connector according to claim 11 wherein said outer sleeve is constrained from expanding outwardly beyond a certain amount as a result of said insulating product being formed into said chamber by being extended to the limits of its elasticity.

13. A plug-in connector for use underwater, comprising a socket provided with a bore adapted to receive a complementary plug and a separate chamber containing an insulating product of substantial viscosity in communication with the bore of the socket through channel means, said channel means arranged in a zone separate and distinct from the bore wherein said plug is received, for filling said bore with insulating product when said plug is withdrawn from the socket, said chamber comprising a rigid tube having a wall traversed by a plurality of channels and an elastic sleeve surrounding the tube and defining therewith said chamber of insulating product, said sleeve having elastic support means associated therewith in the form of a spring having contiguous coil turns encircling the elastic sleeve for reinforcing said elastic sleeve, the interior of said rigid tube being in permanent communication with said bore of said socket, and said sleeve constructed for contacting substantially the entire surface of the outer wall of said rigid tube when said plug is withdrawn from said socket for causing said insulating product to fill said socket.

14. A plug-in connector according to claim 13 wherein said elastic reinforcing means are embedded in said elastic sleeve.

15. A plug-in connector according to claim 13 wherein said elastic sleeve defines a chamber of variable volume.

* * * * *